US008057064B2

(12) United States Patent
Yeh et al.

(10) Patent No.: US 8,057,064 B2
(45) Date of Patent: Nov. 15, 2011

(54) LIGHTING FIXTURE FOR LAMP TUBE

(75) Inventors: Kuo-Kuang Yeh, Guanxi Township, Hsinchu County (TW); Tsung-Ming Chen, Guanxi Township, Hsinchu County (TW)

(73) Assignee: Fuyu Electric Co., Ltd., Hsinchu County (TW)

( * ) Notice: Subject to any disclaimer, the term of this patent is extended or adjusted under 35 U.S.C. 154(b) by 188 days.

(21) Appl. No.: 12/577,185

(22) Filed: Oct. 11, 2009

(65) Prior Publication Data

US 2010/0142197 A1 Jun. 10, 2010

(30) Foreign Application Priority Data

Dec. 8, 2008 (TW) ..... 97221964 U

(51) Int. Cl.
*F21V 11/02* (2006.01)

(52) U.S. Cl. ..... 362/217.03; 362/217.07; 362/291; 362/342

(58) Field of Classification Search ..... 362/217.03, 362/217.04, 217.05, 217.07, 290, 291, 292, 362/325, 342, 354, 396
See application file for complete search history.

(56) References Cited

U.S. PATENT DOCUMENTS

| | | | | |
|---|---|---|---|---|
| 4,407,011 | A * | 9/1983 | Lahm | 362/217.05 |
| 4,646,212 | A * | 2/1987 | Florence | 362/290 |
| 5,908,234 | A * | 6/1999 | Kreeft | 362/342 |
| 7,036,957 | B2 * | 5/2006 | Paravantsos | 362/291 |
| 7,108,398 | B2 * | 9/2006 | Holten | 362/292 |

FOREIGN PATENT DOCUMENTS

| | | |
|---|---|---|
| TW | M326615 | 2/2008 |
| TW | M330418 | 4/2008 |

* cited by examiner

*Primary Examiner* — Y My Quach Lee

(57) ABSTRACT

A lighting fixture for improving the luminance of a lamp tube includes a curved reflecting plate and a lampshade. The lampshade has partition plates with arc surfaces, side plates with inclined planes and end plates with curved surfaces. The lamp tube is disposed at a longitudinal axis of the curved reflecting plate. The reflecting plate reflects the light emitted from the lamp tube and the light reflected from the partition plates to the environment. The side plates are inclined with a certain angle for guiding light, and the end plates with curved surfaces are used to enhance the reflecting light. Thus, light output efficiency is improved and glare is reduced.

5 Claims, 9 Drawing Sheets

LIGHTING FIXTURE FOR LAMP TUBE

BACKGROUND OF THE INVENTION

1. Field of the Invention

The present invention relates to a lighting fixture for improving the luminance of a lamp tube, especially to a lighting fixture that reflects light off a curved reflecting plate and a lampshade for enhancing light output efficiency and reducing glare.

2. The Prior Art

Recently, lighting fixtures have been developed to decrease energy loss and environmental pollution. The studies for lighting technology have been developed toward energy saving, low pollution, and intelligent lighting. Forms and efficiency of illumination are decided by lighting fixtures. Therefore, lighting fixtures with high efficiency, low glare and low light pollution have become popular. For instance, Taiwan Utility Patent Nos. M326615 and M330418 both provide lighting fixtures with reflecting sheets, so as to improve luminance and enhance light output efficiency.

Referring to FIG. 1, Taiwan Utility Patent No. M326615 discloses a device 1 for improving luminance of a fluorescent lamp, which includes a reflecting sheet 10, a housing 12 and two retaining clamps 20. The reflecting sheet 10 is disposed under and protected by the housing 12. A lamp tube (not shown in figure) is disposed below the reflecting sheet 10 and is clasped at two ends by the retaining clamps 20. The concave surface of the reflecting sheet 10 can reflect the rays of light emitted from the lamp tube so that the luminance of the fluorescent lamp is thus enhanced.

However, the device 1 mentioned above has only one reflecting sheet 10 with concave surface, and it is incapable of fully reflect the rays of light. Thus, the device 1 only increases limited luminance, and is unable to reduce glare.

Referring to FIG. 2, Taiwan Utility Patent No. M330418 discloses a reflector unit 2 of a lighting fixture, which includes a carrier plate 30 and a housing 40. There are two lamp holders 32 at two ends of the carrier plate 30 for fixing lamp tubes 50, respectively. The housing 40 has two inclined reflecting surfaces 42 for reflecting the rays of light emitted from the lamp tubes 50. Therefore, illumination may be improved, and it allows a lamp tube with lower wattage to illuminate just like a lamp tube with higher wattage.

However, the reflector unit 2 having two reflecting surfaces 42 can not fully reflect the rays of light. Moreover, it disperses the rays of light. Thus, increased luminance is limited and glare is unable to be reduced.

SUMMARY OF THE INVENTION

A primary objective of the present invention is to provide a lighting fixture for improving the luminance of a lamp tube. The lighting fixture according to the present invention includes a curved reflecting plate and a lampshade connected with the reflecting plate. The lampshade has partition plates with arc surfaces, side plates with inclined surfaces, and end plates with curved surfaces. The lamp tube is disposed at a longitudinal axis of the curved reflecting plate. The light can be directly emitted to the environment from the lamp tube. Moreover, the light emitted from the lamp tube and the light reflected from the partition plates may also be reflected by the reflecting plate to the environment. The side plates that are inclined with a certain angle are used for guiding light, and the end plates with curved surfaces are used to enhance the reflected light. Thus, light output efficiency is improved and glare is reduced.

Therefore, the lighting fixture according to the present invention may overcome the aforementioned disadvantages of prior art. It may reduce the glare and raise the overall light output efficiency of a lamp tube.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
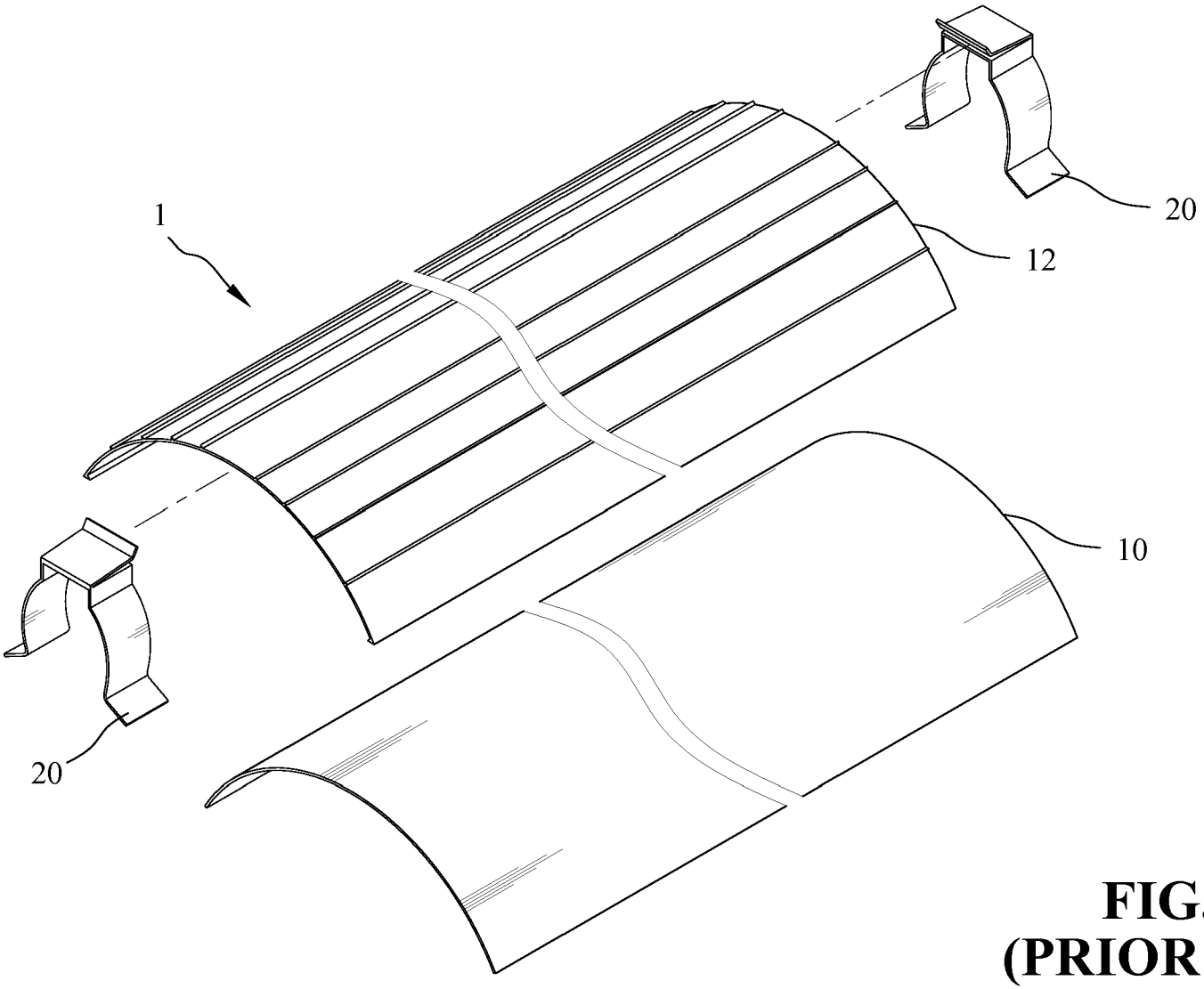
FIG. 1 (PRIOR ART)
FIG. 1 is an exploded view of a conventional device for improving luminance of a lamp tube.
Figure 2:
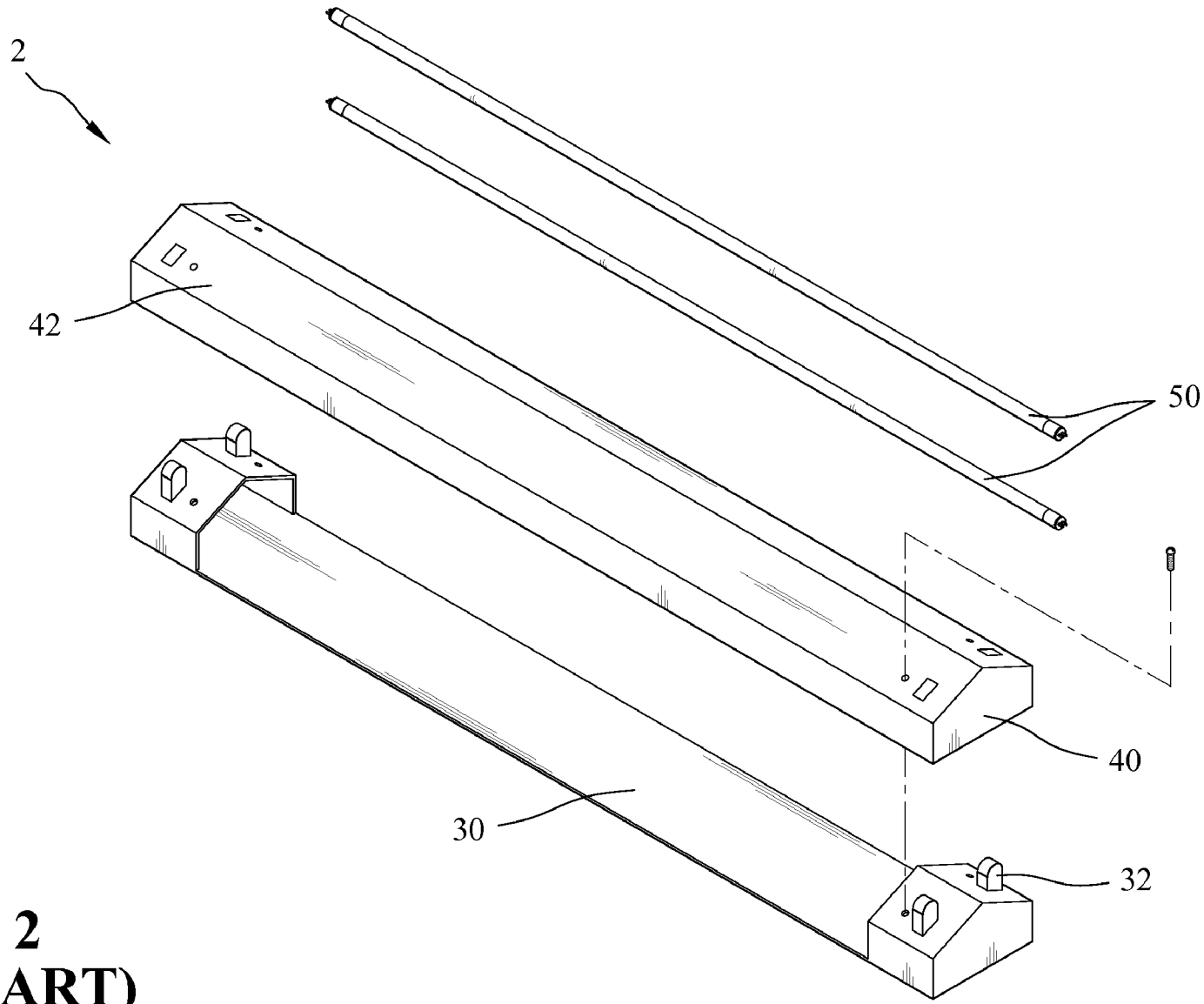
FIG. 2 (PRIOR ART)
FIG. 2 is an exploded view showing a reflector unit of another conventional lighting fixture.
Figure 3:
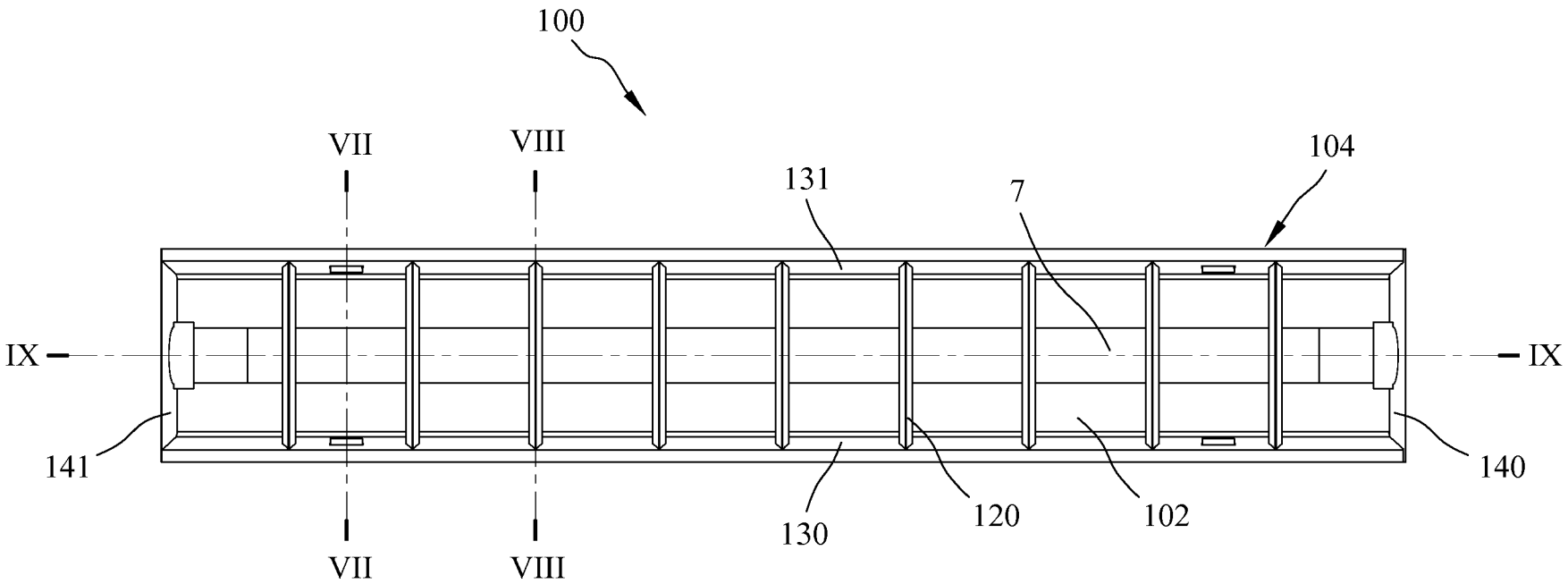
FIG. 3 is a bottom view showing a lighting fixture for improving luminance of a lamp tube according to the present invention.
Figure 4:
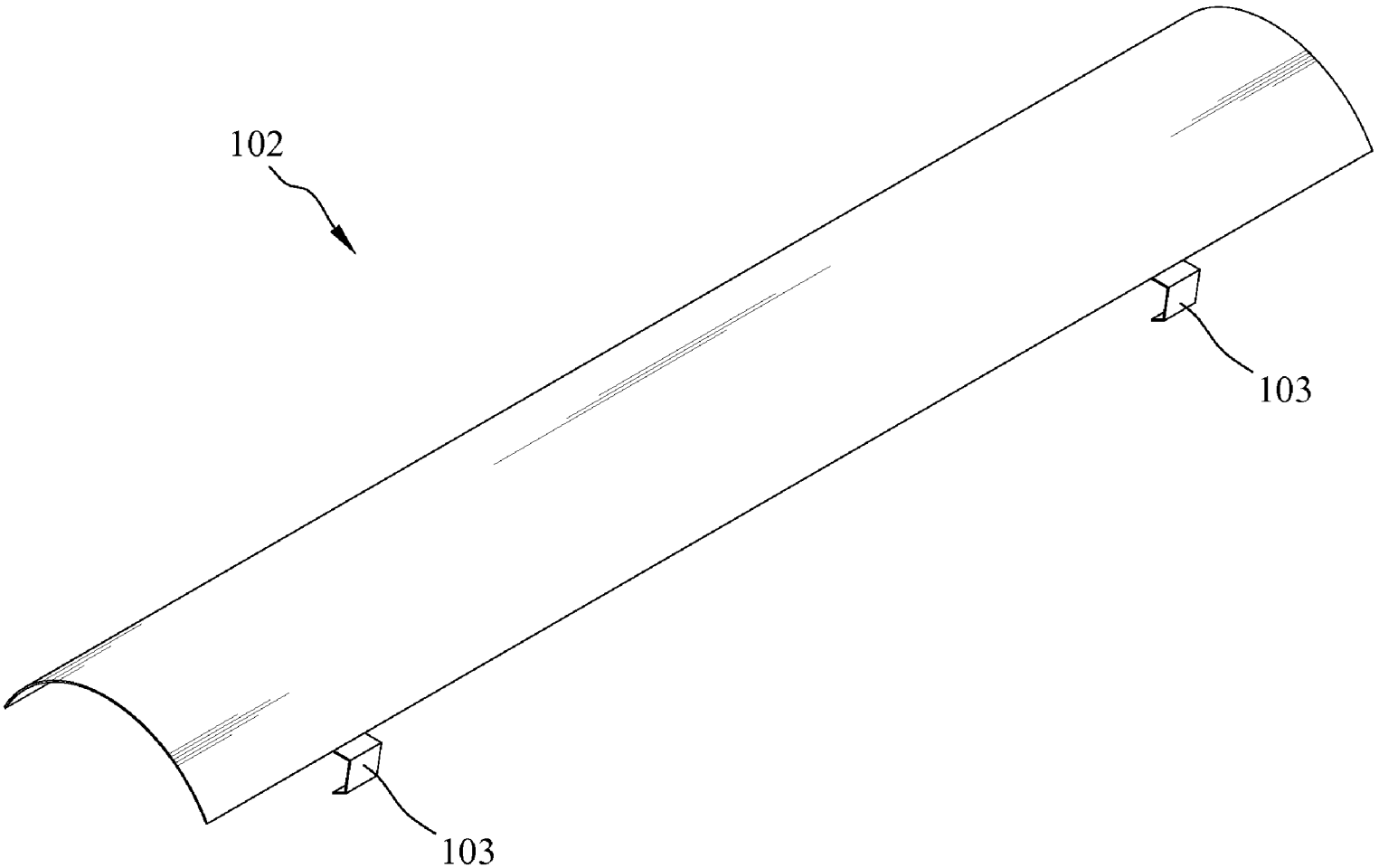
FIG. 4 is a perspective view showing a reflecting plate of the lighting fixture according to the present invention.
Figure 5:
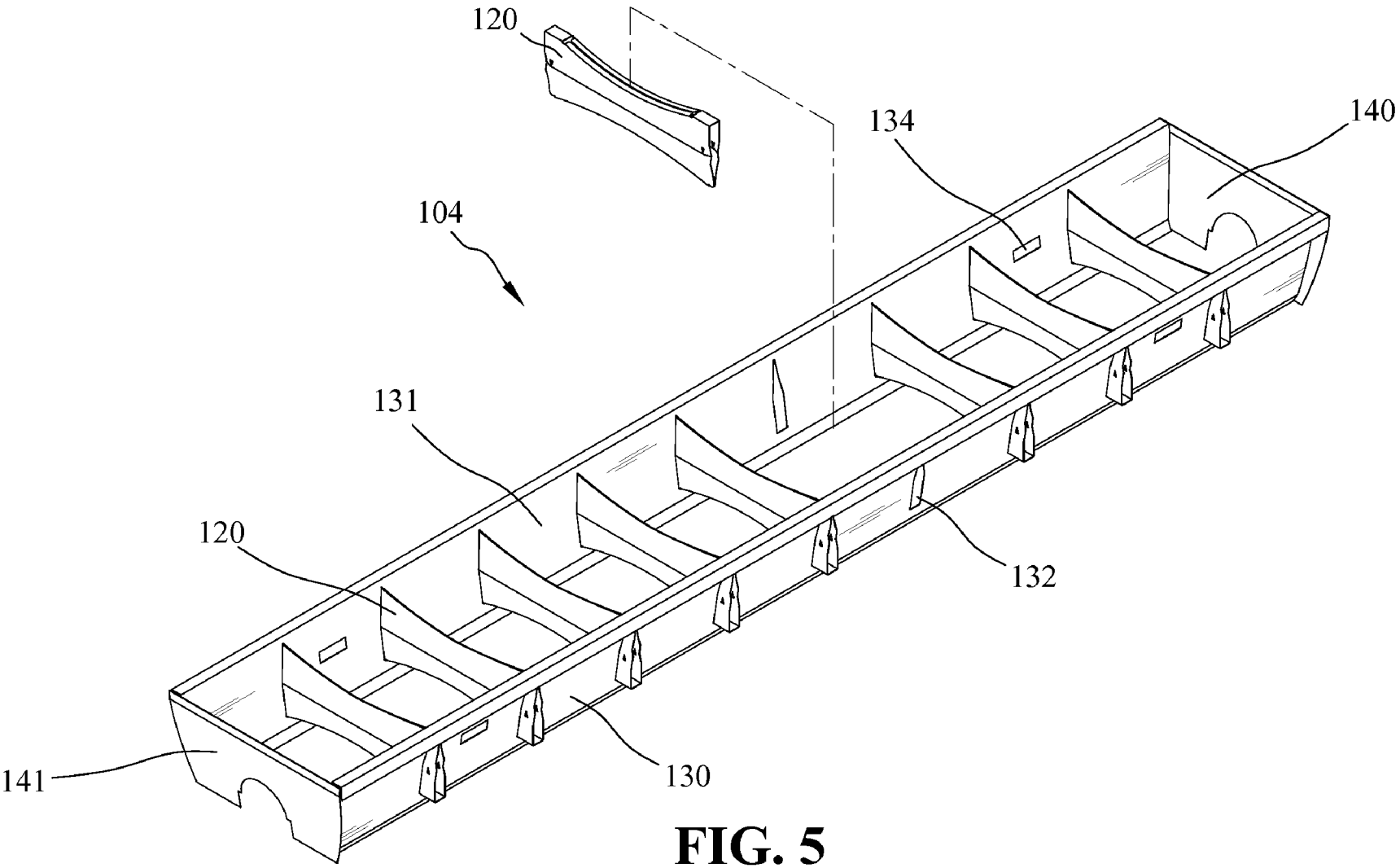
FIG. 5 is a partially exploded view showing a lampshade of the lighting fixture according to the present invention.
Figure 7:
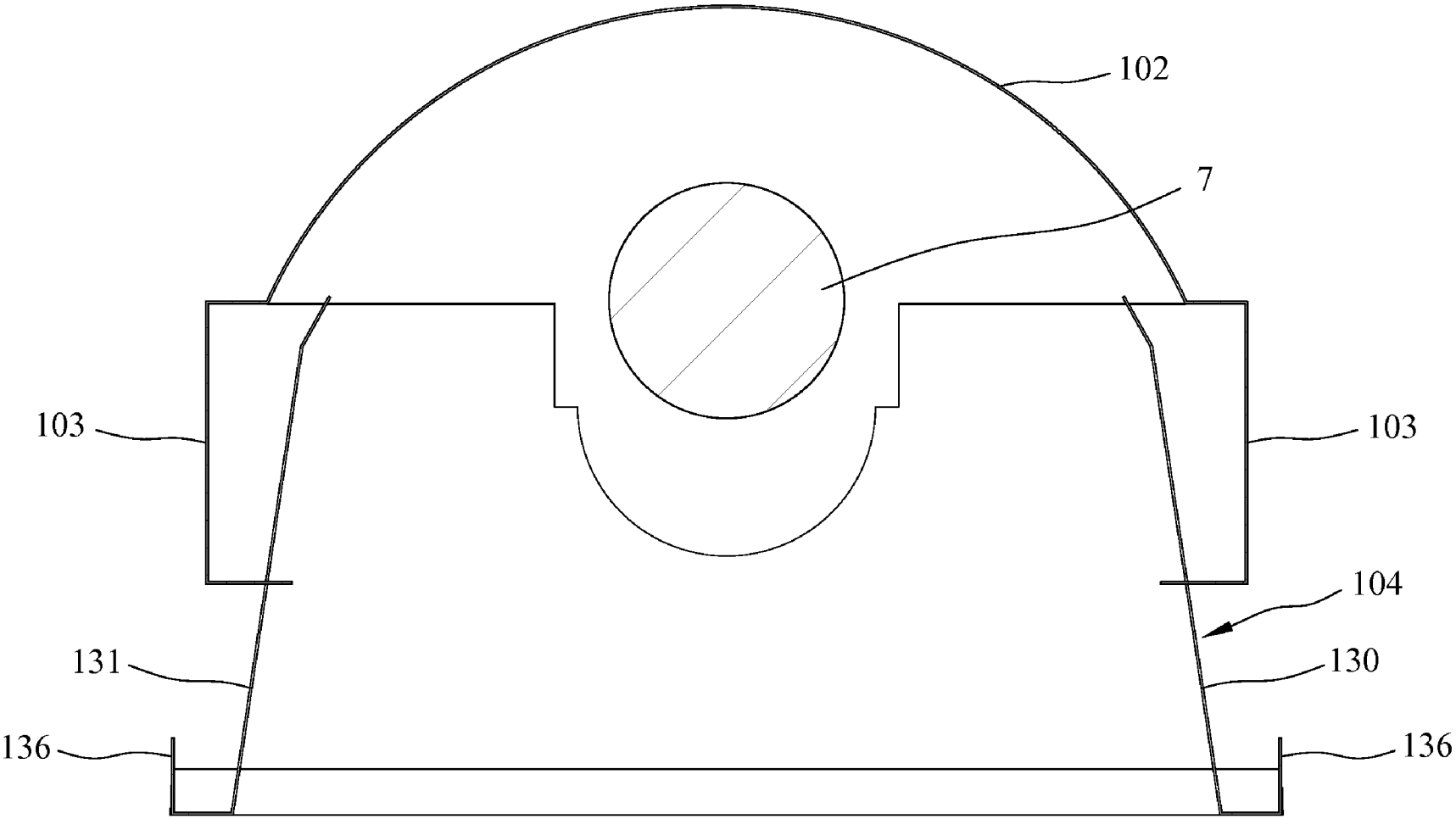
FIG. 7 is a cross-sectional view taken alone the line VII-VII of FIG. 3.

Referring to FIGS. 3, 4 and 5, a lighting fixture 100 for improving the luminance of a lamp tube 7 according to the present invention includes a reflecting plate 102 and a lampshade 104 disposed under the reflecting plate 102. Both the reflecting plate 102 and the lampshade 104 are made of aluminum with a mirror finish. The lampshade 104 includes a plurality of partition plates 120, a first side plate 130, a second side plate 131, a first end plate 140 and a second end plate 141. The lamp tube 7 is surrounded by the reflecting plate 102 and the lampshade 104 as shown in FIG. 7. The reflecting plate 102 and the lampshade 104 are used for reflecting the light emitted from the lamp tube 7 to improve the overall light output efficiency of the lighting fixture 100. The lampshade 104 includes a light output opening located at a bottom thereof. The first side plate 130, the second side plate 131, the first end plate 140, and the second end plate 141 constitute a rectangle, and the partition plates 120 are disposed in the rectangle and are located above the light output opening of the lampshade 104.

Referring to FIG. 4, the reflecting plate 102 has a concave shape. Each longitudinal side of the reflecting plate 102 has two side hooks 103 to connect with the lampshade 104.

Referring to FIGS. 5 and 7, both of the first side plate 130 and the second side plate 131 are inclined planes and are respectively located at both longitudinal sides of the lampshade 104. Both the first side plate 130 and the second side plate 131 have a plurality of side holes 132 corresponding to the partition plates 120 and two side hook holes 134 corresponding to the side hooks 103. The side holes 132 are used for connecting with the partition plates 120, and the side hook holes 134 are used for connecting with the side hooks 103 of the reflecting plate 102. The first end plate 140 and the second end plate 141 both have curved surfaces and are respectively located at a front end and a back end of the lampshade 104. Both the first end plate 140 and the second end plate 141 have a recess for receiving and fixing the lamp tube 7.

Figure 6:
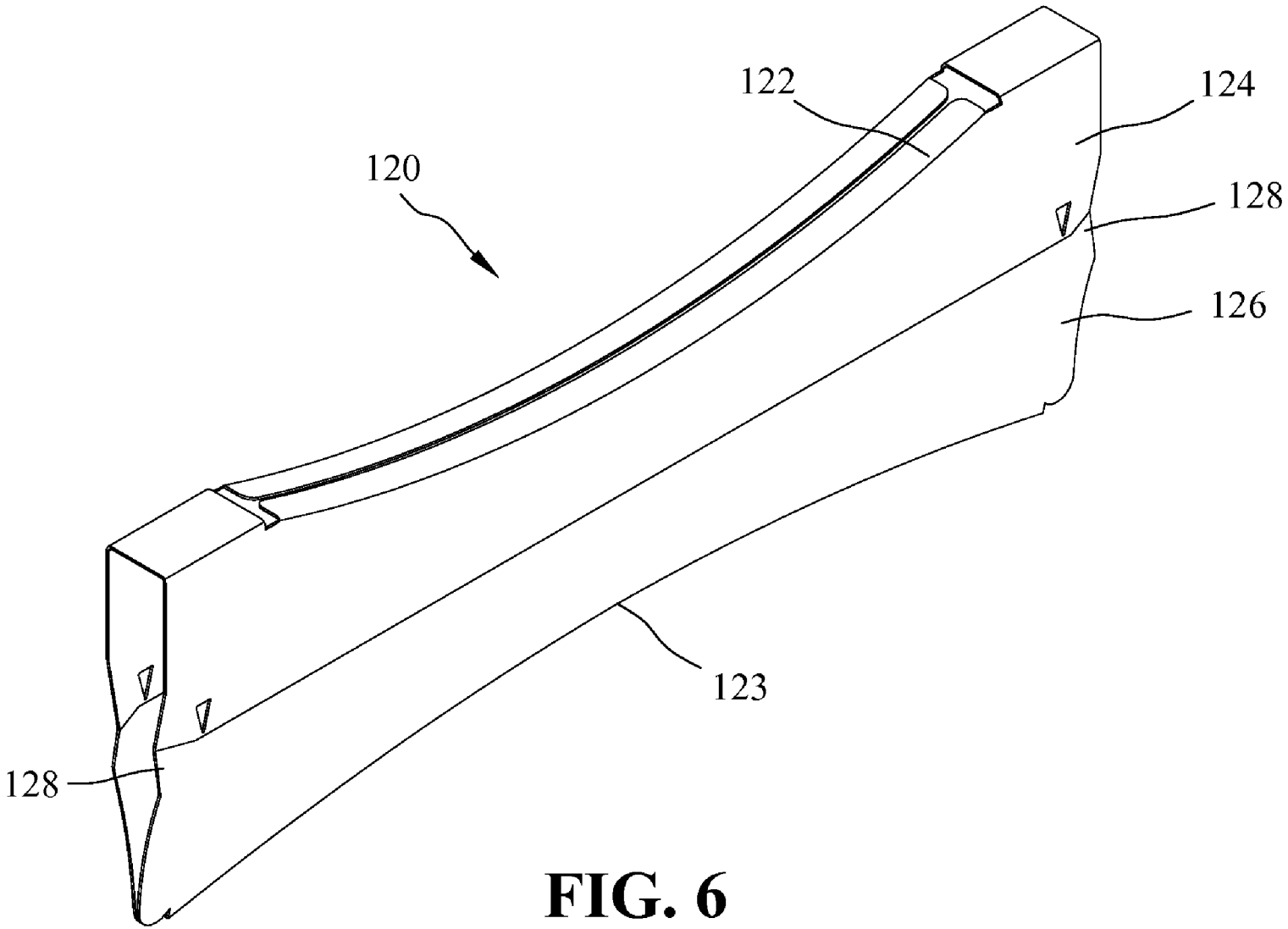
FIG. 6 is a perspective view showing a partition plate of the lighting fixture according to the present invention.

Referring to FIG. 6, the partition plate 120 is folded by an aluminum sheet with a mirror finish. The partition plate 120 includes a first surface and a second surface. Both the first surface and the second surface include an upper inclined plane 124 and a lower curved surface 126. The upper inclined planes 124 of the first surface and the second surface are connected to form a top portion 122 having an arc surface. The lower curved surfaces 126 of the first surface and the second surface are connected to form a bottom portion 123 having an arc line. The radius of the curved top portion 122 is larger than that of the reflecting plate 102. Both sides of the first surface and the second surface have two concave joints 128. The concave joints 128 are wedged to the side holes 132, thereby connecting the partition plate 120 with the lampshade 104.

Referring to FIG. 7, the lamp tube 7 is disposed at a longitudinal axis of the curved reflecting plate 102 and surrounded by the reflecting plate 102 and the lampshade 104. The side hooks 103 disposed at the two sides of the reflecting plate 102 are engaged into the side hook holes 134 of the side plates 130 and 131, so as to connect the reflecting plate 102 with the lampshade 104. The bottom ends of the first side plate 130 and the second side plate 131 have U-shape bending angles 136. The U-shape bending angles 136 are used for enhancing the mechanical strength and further holding the partition plates 120.

Figure 8:
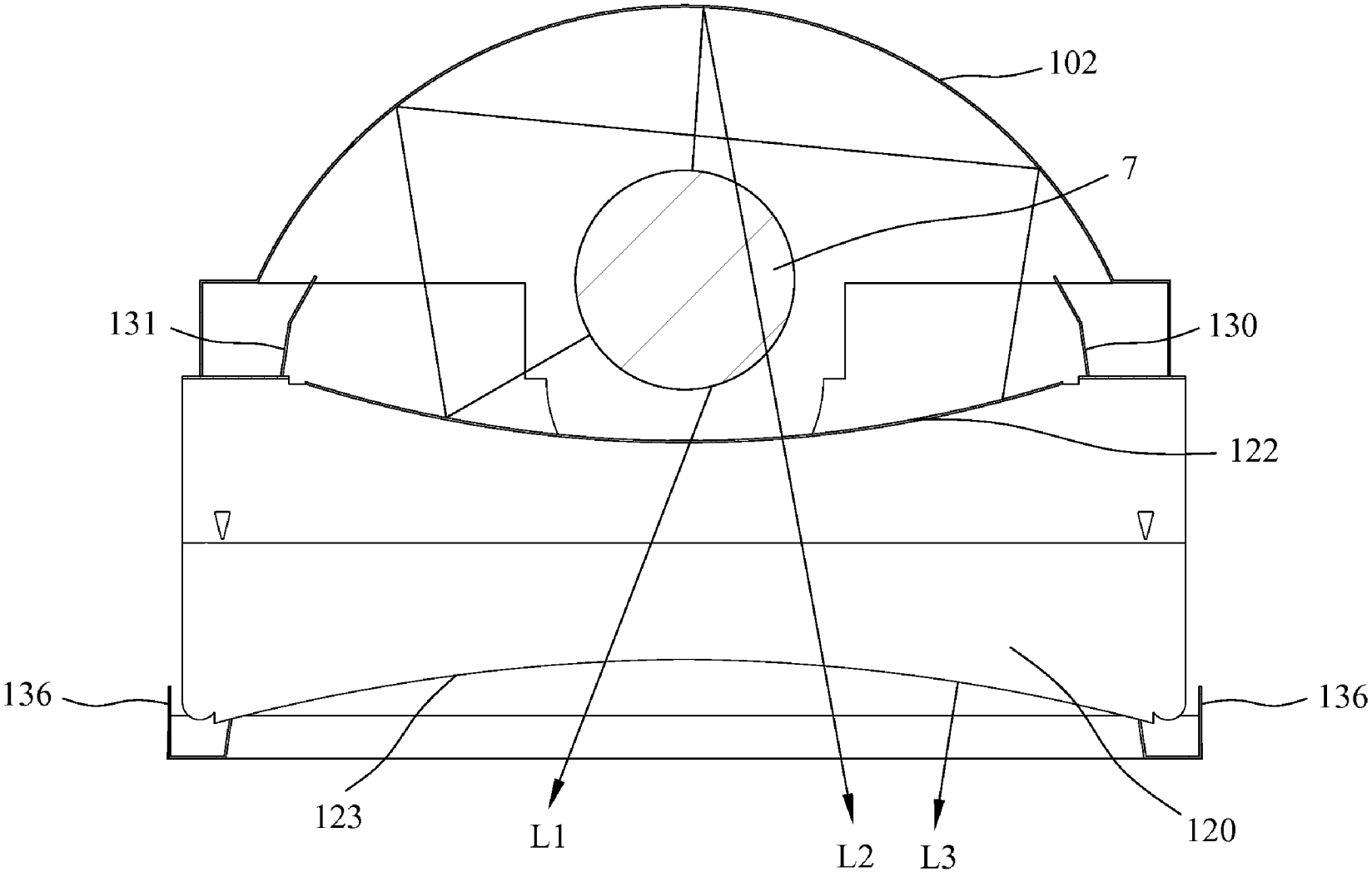
FIG. 8 is a cross-sectional view taken alone the line VIII-VIII of FIG. 3.
Figure 9:
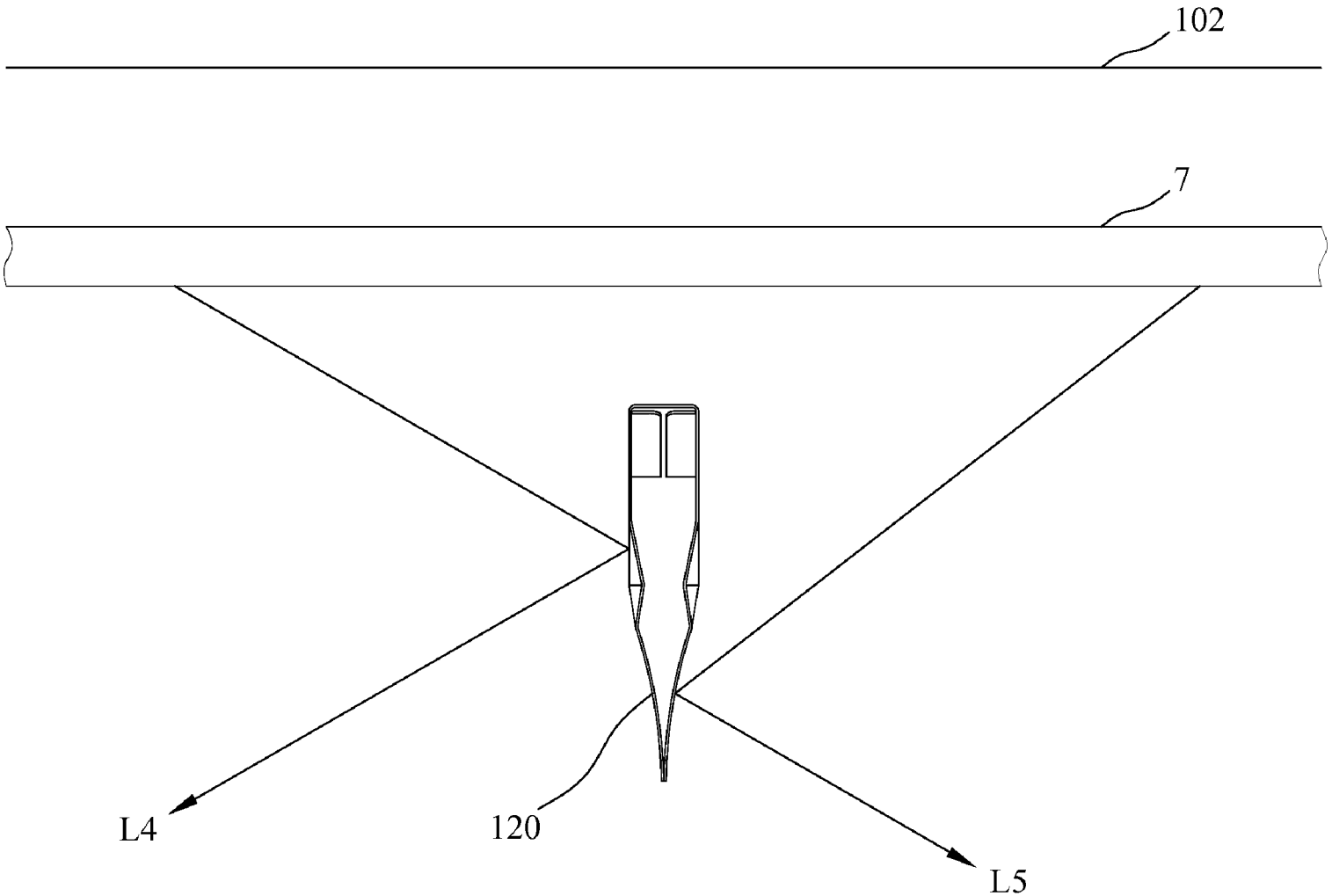
FIG. 9 is a cross-sectional view taken alone the line IX-IX of FIG. 3.

Referring to FIG. 8, the ray of light L1 is emitted from the lamp tube 7 directly to the environment, and the ray of light L2 emitted from the lamp tube 7 is reflected to the environment by the reflecting plate 102. Referring to FIG. 9, when the light is emitted to the partition plates 120, the ray of light L4 is reflected to the environment by the upper inclined plane 124 of the partition plate 120, and the ray of light L5 is reflected to the environment by the lower curved surface 126 of the partition plate 120. Moreover, the ray of light L3 emitted from the lamp tube 7 is reflected to the reflecting plate 102 by the partition plate 120, and then the ray of light L3 is reflected to the environment by the reflecting plate 102 as shown in FIG. 8. Thus, glare is reduced to Unified Glare Rating (UGR) 13-16, and light output efficiency is improved. Further, the side plates 130 and 131 of lampshade 104 may be used for improving light guiding, and the end plates 140 and 141 of lampshade 104 may be used for enhancing light reflecting. Thus, the lighting fixture according to the present invention produces the lighting efficiency of 98.4%.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A lighting fixture for a lamp tube, which is adapted for improving a light output efficiency of the lamp tube, comprising:

a concave reflecting plate; and a lampshade disposed under the reflecting plate and comprising a first side plate, a second side plate, a first end plate, a second end plate and a plurality of partition plates; the first side plate, the second side plate, the first end plate, and the second end plate forming a rectangle, and the partition plates being disposed in the rectangle and above a light output opening which is located at a bottom of the lampshade;

wherein each of the partition plates comprises a first surface and a second surface, each of the first surface and the second surface comprises an upper inclined plane and a lower curved surface, the upper inclined plane of the first surface and the upper inclined plane of the second surface are connected to form a curved top portion having an arc surface, the lower curved surface of the first surface and the lower curved surface of the second surface are connected to form a bottom portion having an arc line, a radius of the curved top portion is larger than that of the reflecting plate, both the first surface and the second surface have two concave joints, both the first side plate and the second side plate are inclined planes and are respectively located at both sides of the rectangle, each the first side plate and the second side plate has a plurality of side holes corresponding to the partition plates and two side hook holes corresponding to the side hooks, the concave joints of the partition plate are wedged into the side holes to connect the partition plate with the lampshade, and the side hooks of the reflecting plate are engaged with the side hook holes to connect the reflecting plate with the lampshade.

2. The lighting fixture as claimed in claim 1, wherein each longitudinal side of the reflecting plate has two side hooks to connect with the lampshade.

3. The lighting fixture as claimed in claim 1, wherein the first end plate and the second end plate are respectively located at a front end and a back end of the lampshade, and each of the first end plate and the second end plate has a curved surface and a recess for receiving and fixing the lamp tube.

4. The lighting fixture as claimed in claim 1, wherein the lamp tube is located at a longitudinal axis of the concave reflecting plate.

5. The lighting fixture as claimed in claim 1, wherein the reflecting plate and the lampshade are made of aluminum with a mirror finish.

* * * * *